United States Patent [19]

Schuh

[11] Patent Number: 4,640,353

[45] Date of Patent: Feb. 3, 1987

[54] ELECTRODE WELL AND METHOD OF COMPLETION

[75] Inventor: Frank J. Schuh, Plano, Tex.

[73] Assignee: Atlantic Richfield Company, Los Angeles, Calif.

[21] Appl. No.: 842,516

[22] Filed: Mar. 21, 1986

[51] Int. Cl.[4] ..... E21B 7/08; E21B 7/18; E21B 17/20; E21B 36/04

[52] U.S. Cl. ..... 166/248; 166/60; 166/77; 166/117.6; 166/384; 175/61; 175/77; 175/81

[58] Field of Search ..... 166/248, 384, 302, 50, 166/60, 77, 380, 117.6, 65.1; 175/61, 67, 77, 79, 81, 82

[56] References Cited

U.S. PATENT DOCUMENTS

| | | | |
|---|---|---|---|
| 2,495,439 | 1/1950 | Brimble | 166/117.6 X |
| 3,191,697 | 6/1965 | Haines | 175/81 |
| 3,236,304 | 2/1966 | Sarapuu | 166/248 |
| 3,417,823 | 12/1968 | Faris | 166/248 |
| 3,690,136 | 9/1972 | Slator et al. | 166/77 X |
| 3,841,407 | 10/1974 | Bozeman | 166/384 |
| 4,084,639 | 4/1978 | Todd | 166/248 |
| 4,168,752 | 9/1979 | Sabol | 175/61 X |
| 4,489,782 | 12/1984 | Perkins | 166/248 |
| 4,497,381 | 2/1985 | Dickinson, III et al. | 175/61 |
| 4,527,639 | 7/1985 | Dickinson, III et al. | 166/50 X |

*Primary Examiner*—Stephen J. Novosad
*Attorney, Agent, or Firm*—Michael E. Martin

[57] ABSTRACT

An electrode well extending into a subterranean formation containing viscous hydrocarbons comprising a plurality of electrode tubes which are formed by extension of an elongated tube from the surface above the formation using a coiled tube injection unit or lowering the tubes on drill pipe, diverting the tubes radially outwardly from the wellbore into the formation and penetrating the formation with the electrode tubes using hydraulic jetting action by pumping fluid through the tubes during the insertion process. The tubes are installed axially spaced apart using respective tube guide members which are inserted into the wellbore and operate to form a curved path for diverting the tubes into the formation during the insertion process and for supporting the end of the tube after its insertion into the wellbore. Electrical contact is established between the plural tubes and their support members by the insertion of a length of tubing into the wellbore including a connector member at the distal end thereof, and which is connected to one end of the electrode tube support assembly.

21 Claims, 10 Drawing Figures

ELECTRODE WELL AND METHOD OF COMPLETION

BACKGROUND OF THE INVENTION

1. Field of the Invention

The present invention pertains to a subterranean electrode well having improved electrodes formed by generally horizontally extending flexible metallic tubes which extend radially outward from the wellbore and are in electrically conductive communication with a conductor extending within the well from a surface source of electrical energy.

2. Background

In the continuing effort to develop subterranean formations which contain large deposits of viscous hydrocarbons, there have been several proposals to reduce the viscosity and improve the flowability of the hydrocarbon materials by passing electric current through the formation to achieve resistance heating of the formation and to thereby lower the viscosity of the hydrocarbon materials contained therein.

One of the problems with developing resistance heating of subterranean formations pertains to the rather localized heating which occurs at the interface between the electrode structure and the formation itself. This localized heating can be so intense as to vaporize the fluids in the vicinity of the electrode thereby reducing electrode contact with the formation and the distribution of the resistance heating through the formation itself.

One proposal for increasing the electrode contact area with the formation structure is disclosed and claimed in U.S. Pat. No. 4,084,639 to J. C. Todd and assigned to the assignee of the present invention. This patent discloses an arrangement of an electrode well which includes a plurality of electrically conductive rods which extend radially outwardly from a central wellbore to provide increased electrode area for conducting current into the subterranean formation. However, the radial extent of the rod members described in the Todd reference is limited by the configuration of the apparatus itself and the rods penetrate the formation only to the extent that mechanical displacement will permit.

It has also been proposed in the art of developing subterranean reservoirs containing hydrocarbon substances to drill horizontal boreholes radially outward from a vertical wellbore by extending a bendable metal tube, sometimes referred to as coiled tubing, into the formation by hydraulically jetting or eroding the formation in the path of the tube to form the horizontal borehole. The tubing is extended radially outward from the borehole axis using a whipstock apparatus which is constructed to enable the tubing "drill string" to move from the vertical borehole through a relatively short radius ninety degree turn. This method of drilling horizontal boreholes is completed by electrochemical milling of the radially extended tube in the vicinity of its departure from the wellbore to, in effect, disconnect the tube from the well casing or structure upon completion of the horizontal borehole itself.

Other techniques have been developed for drilling so-called horizontal drain holes which extend generally radially outward from a conventional vertical wellbore to enhance the recovery of hydrocarbon substances of subterranean formations. These drain hole drilling processes typically involve the rotation of a drill stem having an articulated or flexible section and to which is connected a conventional rotary bit. Alternatively, some drain hole drilling processes contemplate the utilization of a downhole fluid operated drilling motor which must be retrieved after completion of the drilling process.

It is an object of the present invention to provide an improved electrode well for enhanced hydrocarbon recovery operations from subterranean formations wherein the electrode contact area is significantly increased as compared with conventional electrode wells. It is another object of the present invention to provide an electrode well wherein a plurality of current conducting and fluid conducting conduits are extended radially outwardly in selected directions from a substantially vertical wellbore and are electrically connected to conductor means in the wellbore. The tubes are also maintained in fluid flow communication with the wellbore for conducting an electrolyte into the formation or, alternatively, producing fluids from the formation through the wellbore. These objects and other features of the present invention are described in further detail herein.

SUMMARY OF THE INVENTION

The present invention provides an improved electrode well wherein substantially increased electrical conductor contact area is provided in the vicinity of a wellbore and extending radially outwardly into a subterranean formation into which the wellbore has been drilled to stimulate the recovery of viscous hydrocarbons through resistance heating of the formation itself.

In accordance with one important aspect of the present invention, an electrode well is formed by a vertical or inclined wellbore from which extend, in selected radial outward directions, a plurality of conductive metal tubes. These tubes are anchored to conductor structure in the wellbore and are extended into the subterranean formation at least partially by hydraulic jetting action to provide penetration of the tubes a substantial distance radially from the axis of the wellbore.

In accordance with another important aspect of the present invention, an electrode well is provided wherein a substantial number of vertically spaced electrical conductor tubes are extendable into a subterranean formation and are adapted to be interconnected with a source of electrical energy and with a source of pressure fluid to distribute electrical current flow through a subterranean formation for resistance heating of the formation to enhance the recovery of hydrocarbon fluids contained therein.

In accordance with still another important aspect of the present invention, there is provided unique conductor tube support structure for an electrode well, including a guide member having a curved passage formed therein for guiding a bendable metal tube section generally radially outwardly from the wellbore as it is being inserted axially through the well. A portion of the guide passage is curved in the opposite direction at the exit point of the tube from the guide member to straighten the bendable tube while it is being inserted into the formation adjacent the wellbore. The unique guide members also form anchor points for the electrode tubes for connection to a source of electrical energy.

The present invention also provides a unique method of constructing an electrode well wherein a coiled tubing injection unit or a conventional rotary drill rig is utilized to inject bendable metal tubing into a wellbore and extend the tubing radially outwardly utilizing a guide member or shoe disposed in the wellbore. Successive vertically spaced apart tubes and guide members may be interconnected in the wellbore for conducting electrical current to each of the conductor or electrode tubes, and pressure fluid may be conducted through the tubes between the formation and the wellbore.

Those skilled in the art will recognize the above described advantages, objects and features of the present invention as well as other superior aspects thereof upon reading the detailed description which follows in conjunction with the drawing.

DESCRIPTION OF PREFERRED EMBODIMENTS

Figures 1, 3, 4:
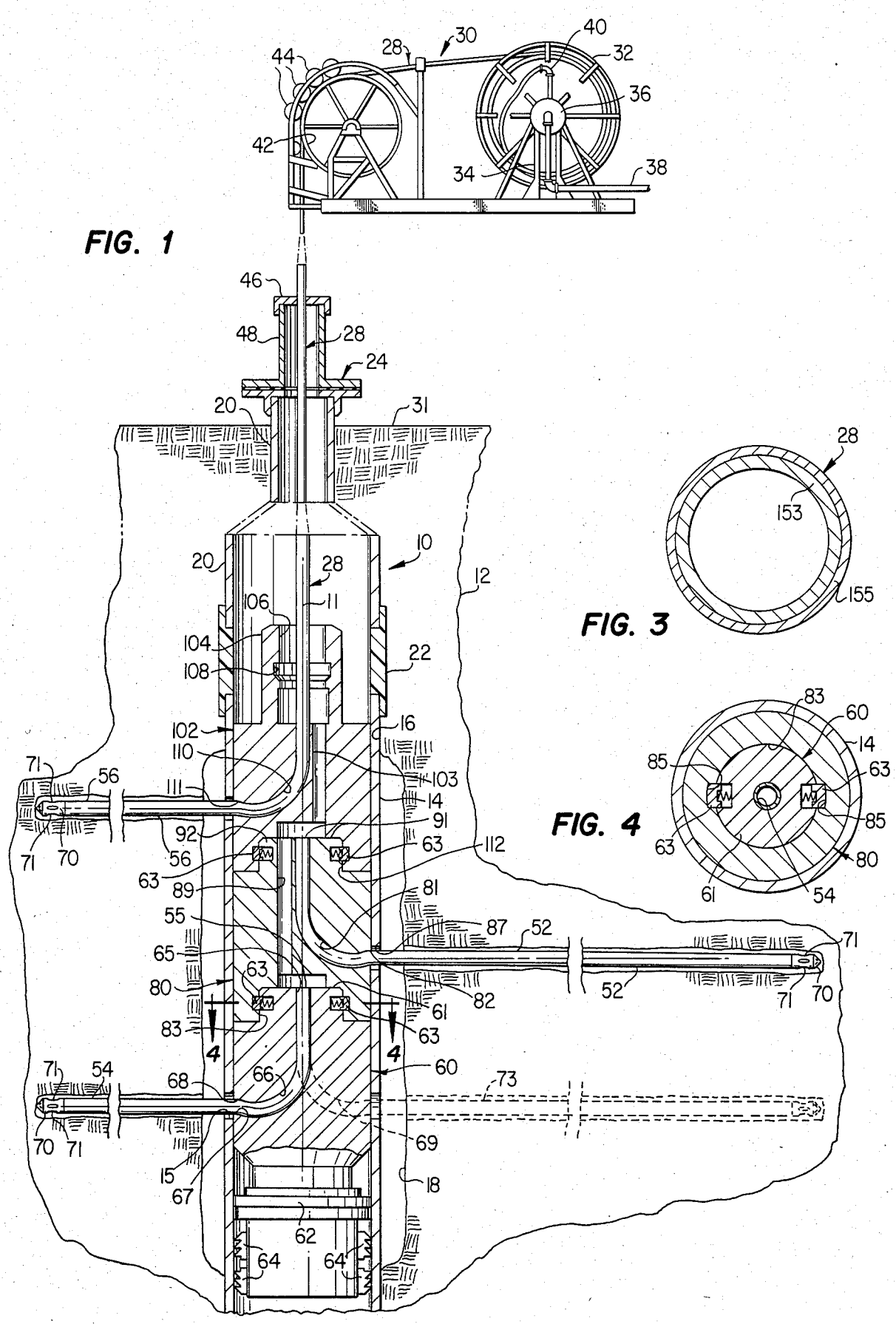
FIG. 1 is a vertical section view through a subterranean formation showing, in somewhat schematic form, the installation of an electrode well of the present invention.
FIG. 3 is a transverse section through one of the electrode tubes showing the composite construction thereof.
FIG. 4 is a section view taken along line 4—4 of FIG. 1.

In the description which follows, like parts are marked throughout the specification and drawing with the same reference numerals, respectively. The drawing figures are not necessarily to scale, and the scale of certain components in a drawing figure may be enlarged in one part of the figure with respect to the same components in another part of the figure in the interest of clarity and conciseness. Conventional elements may be shown in somewhat schematic form, or described in general terms only.

Referring to FIG. 1, there is illustrated an arrangement of an electrode well in the process of being completed by the installation of a plurality of tubular members into a subterranean earth formation and extended radially outwardly from the wellbore. In accordance with the present invention it is contemplated that a generally vertical well 10 is drilled into a subterranean formation 12 which may comprise relatively lightly consolidated sands which contain recoverable quantities of viscous or heavy oil which is not readily flowable at formation ambient temperatures. The well 10 is preferably completed using a section of metallic casing 14 which has been run into a portion of a wellbore 16 which may preferably be underreamed to enlarge the diameter of the wellbore as indicated at 18. The amount of underreaming may be determined by the number of horizontal holes to be formed by the injection of the electrode tubes so as to provide space for deposit of the earth cuttings which are removed during tube injection. The degree of consolidation of the formation 12 may also dictate whether or not any underreaming is required.

The casing section 14 is preferably coupled to surface casing 20 by an electrically nonconductive coupling section 22. Alternatively, the casing section 14 may itself be electrically nonconductive in some instances. The surface casing 20 terminates at a wellhead 24, having a suitable bonnet structure 26, which permits the running of elongated, relatively thin-walled metallic tubing 28 into the wellbore from a coiled tubing injection unit, generally designated by the numerial 30.

The tubing injection unit 30 may be one of several types commercially available and is suitably mounted on means, not shown, located at the surface 31 of the formation 12 and above the wellhead 24. The exemplary unit 30 shown is characterized by a relatively large diameter reel 32 on which a substantial length of possibly several thousand feet of metal tubing is stored in a fashion not unlike the storage of cable or other flexible material on a spool. The reel 32 is supported on suitable bearing structure 34, including a swivel fitting 36, which provides for connection of a fluid conduit 38 to one end of the tubing as indicated at 40, whereby pressure fluid may be conducted through the tubing 28 during an insertion operation to be described hereinbelow. The tubing injection unit 30 further includes a powered injection spool 42 over which the tubing 28 is trained and guided by a set of guidance and straightening rollers 44. Accordingly, the tubing 28 may be dereeled from the reel 32 and injected into the well 10 through the wellhead structure 26, which may include a suitable stuffing box 46 and a lubricator structure 48 adapted to provide for insertion of certain tools and elements into the casing 20 and 14.

The present invention contemplates the provision of an electrode well such as the well 10, by the insertion of plural electrode members comprising sections of tubing 52, 54 and 56 which have been injected into the formation 12 generally radially outwardly with respect to the central longitudinal axis 11 of the well 10. In this regard, it is contemplated that the well 10 is provided with a plurality of members which function as landing collars or guide shoes in combination for locating the point of injection of one of the electrode tubes, and for guiding the electrode tube to turn from a generally vertical course radially outward from the well axis into the formation 12. FIG. 1 illustrates the completion of insertion of the electrode tubes 52 and 54, which has been carried out by first locating the insertion point of the lowermost electrode tube 54, utilizing a guide member 60. The electrode guide member 60 may be of special construction for initially locating the point of injection of the electrode tube 54 and may include a suitable annular seal 62 and radially extendable slips 64, which are adapted to grip the inner wall of the casing section 14 to locate the guide member 60 in the wellbore. The lower portion of the guide member 60, comprising seal 62 and the slips 64, may be constructed substantially identical to a conventional well packer, such as a type R3 Double Grip Packer, manufactured by Baker Packers division of Baker Oil Tools, Inc., Houston, Tex.

Alternatively, the casing section 14 and the guide member 60 could be provided with cooperating interfitting tongue and groove portions to provide for locating the guide member 60 vertically and rotationally in the casing section 14. The guide member 60 is also provided with at least one curved passage 66 which curves in one direction from a generally axial entrance 65 to a substantially radially outwardly directed exit 67 for guiding the tube 54 as it is inserted through the wall of the casing section 14 and into the formation 12. The passage 66 has a portion 68 which curves in the opposite direction with respect to the remainder of the passage just adjacent the exit 67 so that as the electrode tube 54, for example, is forced through the passage 66 the tube is straightened just prior to its exit from the guide member 60. In this way, the electrode tubes, such as the tube 54, are substantially straight as they are driven into the formation 12.

It is contemplated that the electrode tube 54 may be formed and inserted into the formation 12 by first inserting a distal end of the tubing 28 into the passage 66 of the guide member 60, after the guide member has been inserted into the lubricator 48 for lowering into the wellbore within the casing sections 20 and 14. The distal end of the tubing 28 would typically be inserted into the curved passage 66 only sufficiently far enough to maintain the member 60 connected to the tubing 28 due to the relative stiffness of the tubing itself. The guide member 60 would then be lowered into the casing section 14 and set in position by actuation of the slips 64. At this point, an opening 15 in the wellbore casing section 14 would be preformed by, for example, electrochemical milling or by forcible removal of a plug, not shown. After location of the guide member 60 such that the tube passage exit 67 registers with the opening 15 or the opening 15 is then formed, the tubing injection unit 30 is operated to commence injection of the tubing 28 radially outwardly into the formation 12 to form the electrode tube 54.

As shown in FIG. 1, each of the electrode tubes, including the electrode tubes 52, 54 and 56, are provided with hydraulic jetting bits 70 suitably connected to the distal ends of the respective electrode tube 52, 54 and 56 when they are each still part of the tubing 28. The bits 70 are each provided with suitable fluid exit ports 71 which effect the formation of a hole for insertion of the electrode tubes by hydraulically cutting or eroding the formation material and conveying the material out of the respective holes thus formed and into the space formed between the underreamed portion of the wellbore 18 and the casing section 14 to thus provide for insertion of a substantial length of tubing into the formation. It is contemplated that tubing lengths of 100 feet to 200 feet may be injected into the formation, such as the formation 12, to form the electrode tubes 52, 54 and 56. Depending on the consolidation of the formation 12, the electrode tubes may be mechanically forced into the formation a substantial distance, with or without the assistance of hydraulic jet cutting of the formation to assist with penetration of the tubes. The electrode tube 54 may be inserted by mechanically forcing the tube 28 radially outwardly while pumping pressure fluid through the tubing 28 from a source, not shown, by way of the conduit 38 whereby, under hydraulic pressures in the range of 5,000 to 10,000 psig, emission of high velocity jets from the bit 70 will assist with penetration of the tube. Although boreholes, slightly larger in diameter than the electrode tubes, are formed by the hydraulic jetting or erosion action of the tubes 52, 54 and 56 as they penetrate the formation 12, these boreholes usually remain fluid filled or otherwise tend to collapse and provide substantial direct contact of formation material with the tubes.

After a sufficient length of tubing 28 has been extended into the formation 12 to form the electrode tube 54, for example, the tube 54 is severed at the top of the member 60 by suitable means. For example, a suitable milling tool, not shown, may be lowered into the wellbore for cutting off the electrode tube 54 from the continuous length of tubing 28. A conventional milling tool of a type commercially available may be utilized to perform the cutoff operation.

As illustrated in FIGS. 1 and 4, the guide member 60 is preferably configured to include a vertically upstanding boss portion 61, which may be adapted to include radially extendable latching dogs 63 disposed thereon. After cutoff of the electrode tube 54 at its upper end, indicated by the numeral 55, a second electrode tube may be lowered and inserted into a second curved passage 69, which may be located off center from the wellbore axis 11. A suitable guide structure, not shown, may be lowered with the distal end of the tubing 28 to provide for guiding a second electrode tube 73 into and through the guide member 60. The passage 66 may be located off center as well as the passage 69, so that several electrode tubes may be projected radially outwardly from the wellbore through the guide member 60. A suitable landing collar, not shown, could be lowered with each successive electrode tube to be inserted, with suitable locating means between the landing collar and the guide member 60, to orient the tube for insertion through its passage in the guide member 60 and radially outwardly into the formation 12.

After one or more electrode tubes, such as the tubes 54 and 73, have been inserted into the formation 12 through the guide member 60, and cut off at their upper ends as described above, the distal end of the tube 28 is inserted into another guide member, such as the guide member 80 illustrated in FIG. 1. The guide member 80 is a generally cylindrical element having a curved passage 81 formed therein with a general axial inlet opening and a generally radial outlet opening with respect to the central longitudinal axis of the guide member 80. The passage 81 also has a portion 82 which is curved in the opposite direction with respect to the remainder of the passage adjacent the exit point of the passage 81 with respect to the guide member so that the tube 52 will be straightened as it exits the guide member and extends into the formation 12. The tube 28 is inserted far enough into the passage 81 to serve to retain the tubing in connection with the guide member 80 due to tube stiffness itself since no substantial resistance to movement of the guide member 80 through the casing 14 would be anticipated. The guide member 80 is provided with a suitable recess 83, see FIG. 4 also, for registration with the boss 61. Opposed radially extending grooves or recesses 85 open into the recess 83 for receipt of the latching dogs 63 so that, as the guide member 80 is lowered into the casing 14, it may be latched to the guide member 60 and rotationally as well as axially located in the casing section 14. Suitable means, not shown, may be provided at the wellhead 24 for twisting the tubing 28 to rotationally orient the guide members 60 and 80, for example, during installation thereof.

Following engagement of the guide member 80 with the guide member 60, another opening 87 is formed in the casing section 14 to permit penetration of the tubing 28 radially outward into the formation 12 to form the electrode tube 52. The electrode tube 52 also includes a suitable hole forming, hydraulic jetting type bit 70 connected to the distal end thereof to assist in penetration of the tubing to form the electrode tube 52. As illustrated in the drawing figures, the guide member 80 is also provided with a generally axially extending passage 89 for conducting fluid therethrough.

After insertion of the electrode tube 52, the aforementioned milling operation would be carried out to cut off the tube 52 to form an open upper end thereof, indicated by the numeral 91. As illustrated in FIG. 1, the member guide 80 also has an upstanding, generally axially located cylindrical boss portion 92, having a plurality of radially extendable latching dogs 63 secured thereon for latching the guide member 80 to another guide member 80, to be disposed thereover, for example, and in registration therewith in the same manner that the guide member 80 is secured to the guide member 60. Those skilled in the art will recognize that successive vertically or axially spaced levels of electrode tubes may be inserted in the formation 12 by running the distal end of tubing 28 on and connected to a guide member 80, landing a guide member 80 on a previously inserted guide member and latching the members together in the manner described hereinabove for connection of guide member 80 to guide member 60.

Figures 2, 9, 10:
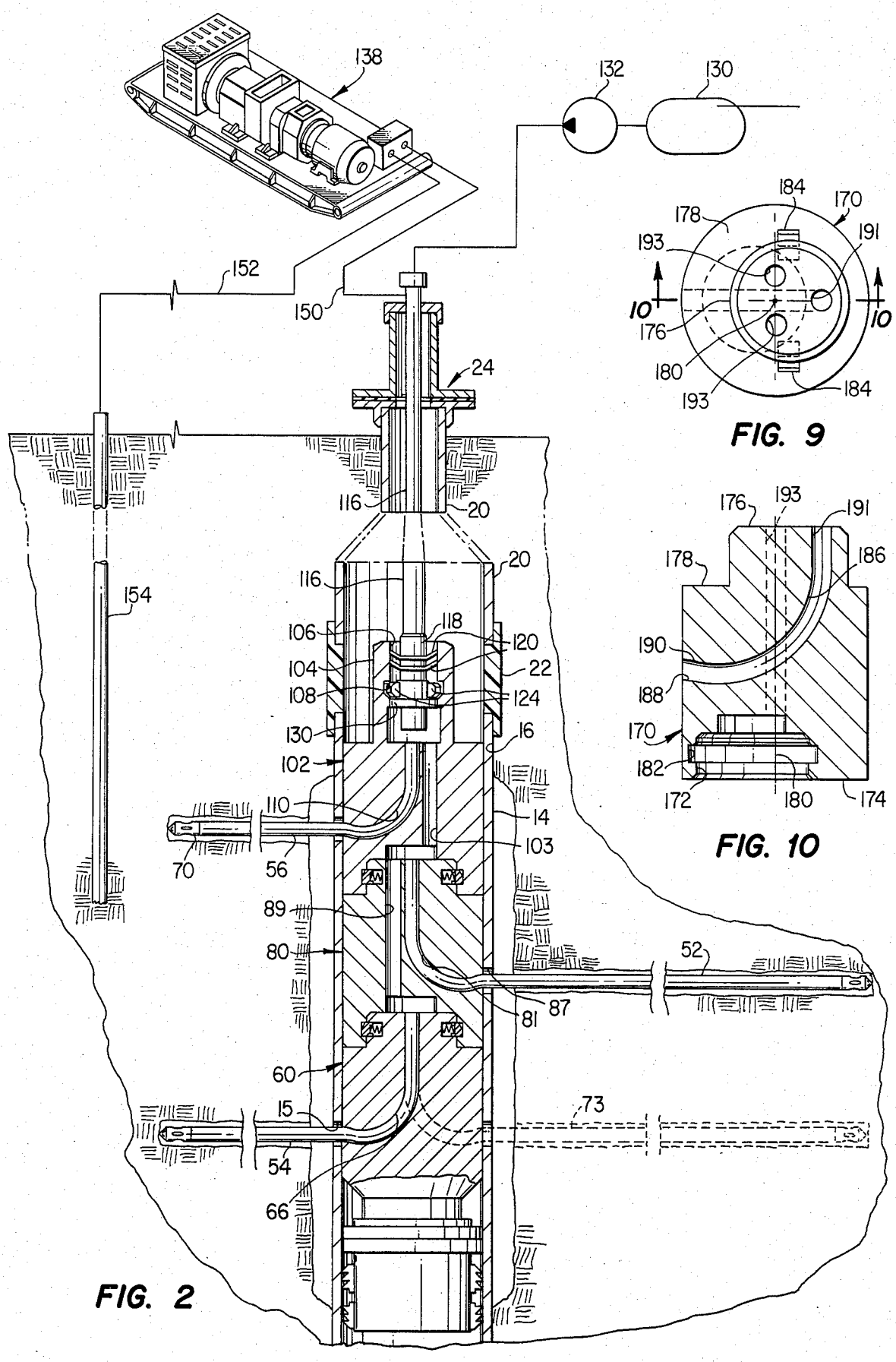
FIG. 2 is a view similar to FIG. 1 showing a completed electrode well.
FIG. 9 is a plan view of an alternate embodiment of an electrode tube guide member.
FIG. 10 is a section view taken generally along the line 10—10 of FIG. 9.

Referring now to FIG. 2 also, when a sufficient number of electrode tubes have been inserted into the formation 12 in accordance with the previous description, a final electrode tube, such as the electrode tube 56, is inserted using a guide member 102 similar in configuration to the guide member 80 but having an upstanding boss 104 formed thereon, with a generally cylindrical bore 106 and an annular recess 108 extending radially outward from the bore 106. A fluid conducting passage 103 extends through guide member 102 from the bore 106 to the passage 89. A curved passage 110 is formed in the member 102 for receipt of the tubing 28 to form the electrode tube 56. The passage 110 is curved in the opposite direction at 111 and near the passage exit to provide for straightening the tube 56 as its exits the guide member. The guide member 102 also has a recess 112, similar to the recess 83, for interlocking the member 102 with a member 80, disposed in the wellbore directly below the member 102.

As shown in FIG. 2, the boss 104 is configured to receive an elongated tube 116 formed from the tubing 28 and having a connector 118 disposed on the lower distal end thereof. The connector 118 includes plural annular seal members 120 which are engageable with the wall of the bore 106 to form a fluidtight seal. The connector 118 includes radially extendable latching dogs 124, which are registerable with the groove 108 to latch the connector 118 and the tube 116 in engagement with the boss 104. The lower end of the connector 118 includes an electrical current contactor portion 130, which is in conductive contact with the boss 104 to form a substantially unrestricted current path from the tube 116 to the assembly of guide members 102, 80 and 60 so that electrical current may pass through these members and through the electrode tubes 52, 54 and 56.

FIG. 2 further illustrates the completion of the electrode well 10 by the connection of the tube 116 to a source of pressure fluid designated by the numeral 130, and including a pump 132 in circuit with the source to pump a suitable electrolyte fluid into the wellbore through the tube 116 and the electrode tubes 56, 52 and 54.

The tube 116 is also connected to a source of electrical energy, such as a gas turbine driven generator 138, whereby a complete circuit may be formed by suitable electrical leads 150 connected to the tube 116 and a lead 152 connected to a suitable electrode 154, embedded in the formation 12. The electrode 154 may be configured as a producing well having the same configuration as the injection well 10 with suitable means for providing for the flow of fluid into the wellbore, which may include the electrode tubes or suitable modifications thereof. Electrolytes such as brine may thus be injected into the formation 12 through the electrode tubes 52, 54 and 56 while electrical energy is transmitted to and through the formation 12 to heat the formation efficiently to improve the flowability of hydrocarbon fluids within the formation.

Thanks to the electrode well system of the present invention, improved electrode contact with a subterranean formation may be formed utilizing elongated electrode tubes. The conductivity of the electrode tubes 52, 54 and 56 may be improved by fabricating the tubes to be clad with a highly conductive metal such as copper. Referring briefly to FIG. 3, for example, the tubing 28 is shown in cross section and comprises an alloy steel core 153 and a layer or overwrap of conductive metal such as copper 155. This tube configuration reduces hysteresis losses from alternating current sources of electrical energy such as the generator set 138.

By utilizing coiled metal tubing as the electrode member, substantial lengths of electrode may be provided utilizing the landing and guide shoe members described herein and the technique for inserting the electrode tubes into the formation by the combined axial thrusting and hydraulic jetting to provide for penetration of the electrodes for up to as much as 100 feet to 200 feet into the formation material. Moreover, the productivity of the well structure for delivering electric current to the formation 12 is also improved by the unique construction of the electrode tube guide and support members, such as the guide members 60, 80 and 102.

Referring briefly to FIGS. 9 and 10, an alternate embodiment of a guide member for use with the electrode well 10 is illustrated and generally designated by the numeral 170. The guide member 170 is a generally cylindrical member of a diameter adapted to be inserted in the casing 14 and having a recess 172 opening to a bottom transverse face 174 and an upstanding cylindrical boss 176 projecting above a transverse face 178. The recess 172 and boss 176 are each offset on opposite sides of a longitudinal central axis 180 of the guide member 170. The recess 172 includes a circumferential groove 182 for receiving latching dogs, such as the latching dogs 184, FIG. 9, of the boss of an adjacent guide member 170, not shown. The dogs 184 are spring biased to project from the periphery of the boss 176 in the same manner that the latching dogs 63 project from the boss portions of the guide members 60 and 80.

The guide member 170 also includes a curved passage 186 which is axially offset with respect to the axis 180 and opens from the boss 176 to the side of the guide member 170 to form an exit 188. The passage 186 has a reversely curved portion 190 adjacent the exit 188 to provide for straightening the tubing 28 as it is forced through the passage 186 from a passage entrance 191 to the exit 188. By offsetting the entrance 191 of the passage 186 with respect to the central axis 180, the radius of curvature of the passage 186 may be more generous to facilitate insertion of the tubes forming the electrode tubes through each of the guide members 170 if they are used in place of the guide members 60 or 80, for example. Longitudinal passages 193 project through the guide member 170 and open into the recess 172 for circulation of electrolyte or other fluids through an electrode well in which the guide members 170 would be used. Other advantages of the guide member 170 are provided by the axially offset recess 172 and boss 176 whereby, as guide members 170 are assembled one on top of the other one guide member is rotated until a boss 176 of one guide member is inserted in the recess 172 of the adjacent guide member. In this way the guide passages 186 are automatically oriented in opposite directions with each succeeding guide member 170 as they are assembled in interlocking relationship.

Figure 5:
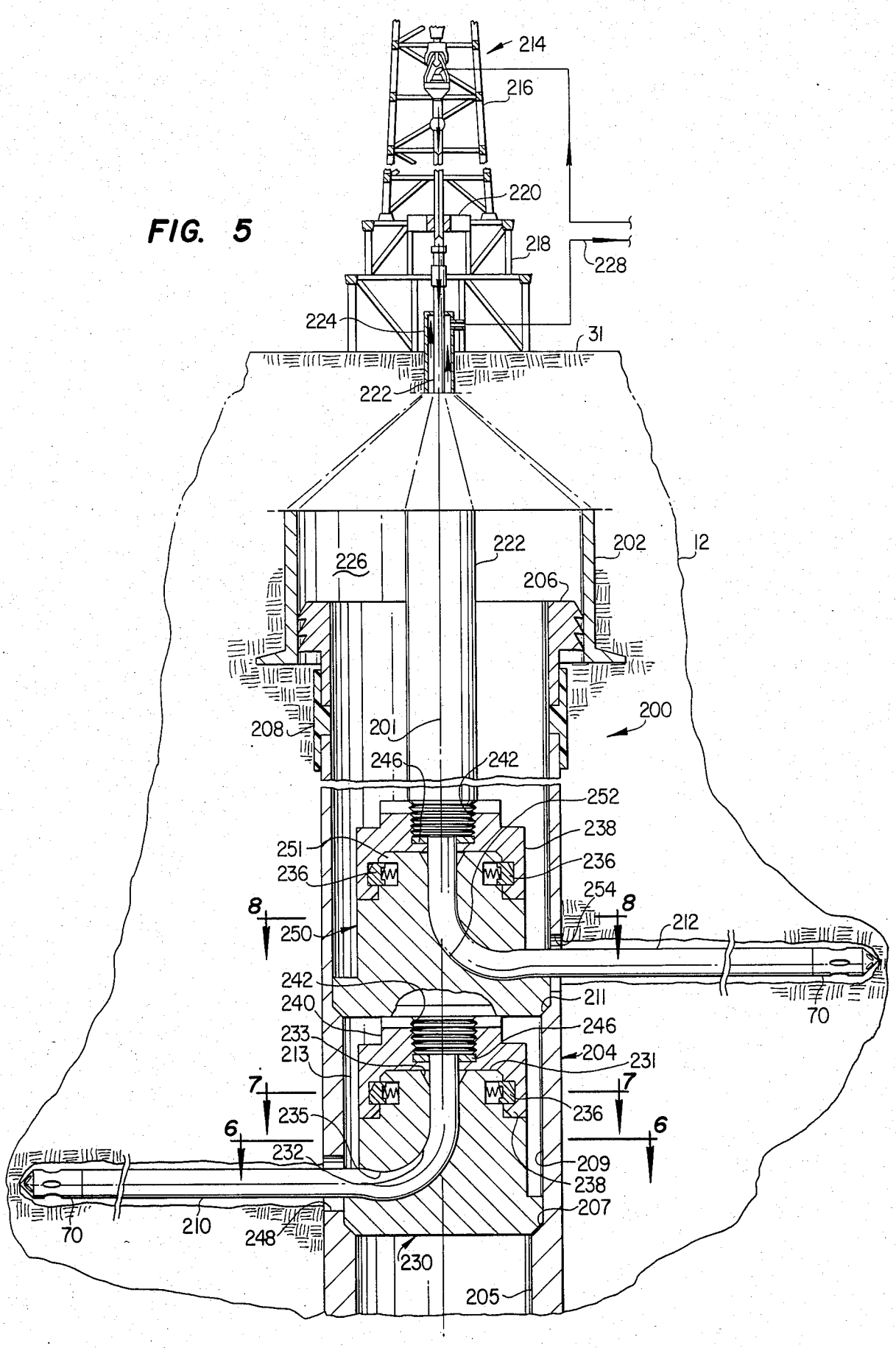
FIG. 5 is a vertical section view through a subterranean formation showing an alternate embodiment of the present invention.

An alternate embodiment of an electrode well in accordance with the present invention is illustrated in FIGS. 5 through 8. Referring to FIG. 5, in particular, an electrode well 200 is shown in the process of being completed in a formation 12 wherein a plurality of elongated metal electrode tubes, formed from the same type of tubing as the tubing 28, are injected into the formation in a predetermined pattern to increase the electrode contact area for the well. The electrode well 200 is formed by a surface casing 202 which extends from surface 31 to a point in the wellbore which has previously been drilled by conventional means and methods to provide for installation of a profiled liner or casing section, generally designated by the numeral 204. The casing section 204 is installed in the wellbore and hung off of the casing 202 by a suitable hanger portion 206. An electrically nonconductive coupling 208 is preferably interposed between the casing section 204 and the hanger member 206 to isolate the surface casing 202 electrically from the electrode section of the well 200.

FIG. 5 illustrates at least two electrode tubes 210 and 212 which may be of the same length, that is approximately 100 feet to 200 feet in length, as the tubes 52, 54 and 56. The electrode tubes 210 and 212 each also include hydraulic jet nozzle type bits 70 secured to the respective distal ends of the tubes to provide a hydraulic jetting or erosion action to assist in penetration of the tubes 210 and 212 into the formation itself. The electrode tubes 210 and 212 have been installed using a conventional drilling apparatus, generally designated by the numeral 214. The drilling apparatus 214 includes a conventional derrick 216, a substructure 218 and a rotary table 220 for handling an elongated drill pipe 222 which extends from the drilling apparatus to the casing or liner section 204. The drill pipe 222 may, of course, be formed in separable sections of suitable length to be handled by the drill rig 214. The surface casing 202 terminates in a suitable wellhead 224 so that drilling fluid may be circulated in a conventional manner down into the casing section 204 through the drill pipe 222 and up through an annular space 226 formed in the casing 202, and through suitable conduit means 228 to a drill cuttings removal and drilling fluid treatment system, not shown.

In contrast with the method of installation of the electrode tubes in the embodiment illustrated in FIGS. 1 through 4, the electrode well 200 is completed using, for example, an electrode guide member 230 which is installed in the casing section 204 by conventional means such as using the drill pipe 222. The guide member 230 includes a curved passage 232 for receiving the electrode tube 210 to guide the tube from a generally axial direction, with respect to the elongated central axis 201 of the well 200, radially outwardly with respect to the well axis 201 into the formation 12. The passage 232 has a flared or funnel shaped tube receiving inlet portion 233. The passage 232 also has a reverse curvature at 235 to provide for straightening an electrode tube inserted through the passage from the inlet 233.

Figure 6:
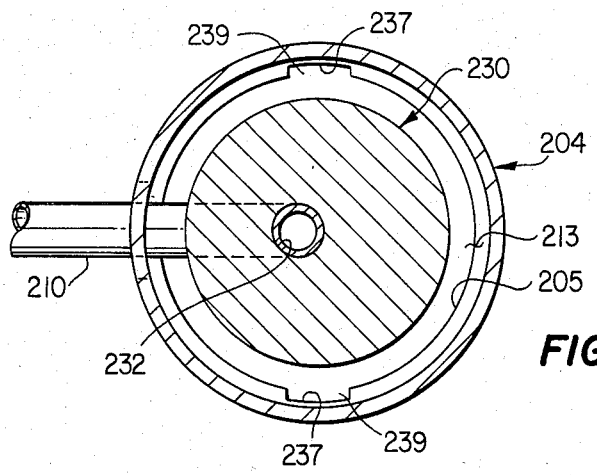
FIG. 6 is a section view taken along line 6—6 of FIG. 5.

As shown in FIG. 6 also, the casing section 204 is suitably profiled on its interior surface by the provision of opposed radially extending recesses 237 for receiving complementary projections 239 formed on the guide member 230 for rotationally orienting the guide member 230 in the bore 205 of the casing section 204. A beveled shoulder 207, FIG. 5, is also formed in the bore 205 for landing the guide member 230 in a predetermined axial position with respect to the casing section 204. An enlarged bore portion 209 is thus formed in the casing section 204 which extends to a second shoulder 211 and an annular flow channel 213 is formed between the guide member 230 and the bore 209 of the casing section. The guide member 230 includes an axially extending boss 231 which includes radially movable latching dogs 236 similar to the latching dogs 63 provided on the guide members 60 and 80 in the embodiment illustrated in FIG. 1. The latching dogs 236 are adapted to register with an electrode tube landing collar 238, FIG. 5, for locking the collar in engagement with the guide member 230. The landing collar 238 also includes an axially projecting boss 240 which is provided with internal threads 242 for engagement with the distal end of the drill pipe 222.

Figure 7:
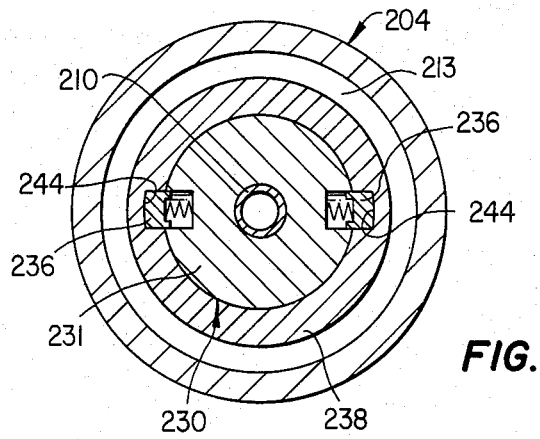
FIG. 7 is a section view taken along line 7—7 of FIG. 5.

As shown in FIG. 7, the landing collar 238 includes opposed recesses 244 which are adapted to register with the latching dogs 236 to lock the landing collar to the guide member 230. The landing collar 238 is adapted to receive one of the electrode tubes, such as the electrode tube 210, and suitably secured thereto such as by welding a flared upper end portion of the electrode tube to the landing collar or providing a collar member 246 secured to the tube and to the landing collar 238. Once the guide member 230 has been installed in the casing section 204, a length of electrode tube such as the electrode tube 210, which would be straight at the time of insertion, is secured to the landing collar 238 and lowered into the wellbore by drill pipe 222.

The electrode tube 210 enters the passage 232 through the flared receiving portion 233, FIG. 5, and is forced to extend radially outwardly as it follows the curved path of the passage 232. A previously formed opening 248 provided in the wall of the casing section 204 is aligned with the guide member 230 in such a way that the electrode tube 210 may exit the casing section through the opening 248 and, with a supply of pressure fluid through the drill pipe 222, the electrode tube may be hydraulically jetted into the formation 12. The opening 248 could be previously closed by a suitable knockout plug or other frangible cover over the opening at the time of installation of the casing section 204. Formation material eroded to form the borehole for receiving the electrode tube 210 may be circulated through the passage 213 up and out of the passage 226 and the casing 202 in a conventional manner such as is carried out during drilling of a borehole in the earth.

After the electrode tube 210 is forced out into the formation 12 to its limit position by engagement of the collar 238 with the guide member 230 the drill pipe 222 may be rotated to decouple from the landing collar 238 in preparation for installation of a second guide member, such as a guide member 250, FIG. 5, for the electrode tube 212. The guide member 250 also includes a curved passage 252 for guiding the electrode tube 212 into a radially outwardly extending position in the formation 12 as illustrated in FIG. 5. An opening 254 is provided in the casing section 204 which may be closed at the time of installation of the casing section 204 by a frangible plug, not shown, so that upon location of the guide member 250 in the position illustrated in FIGS. 5 and 8 and insertion of the electrode tube 212 through the passage 252, the aforementioned plug may be forcibly removed from the casing section to permit entry of the tube 212 into the formation.

Figure 8:
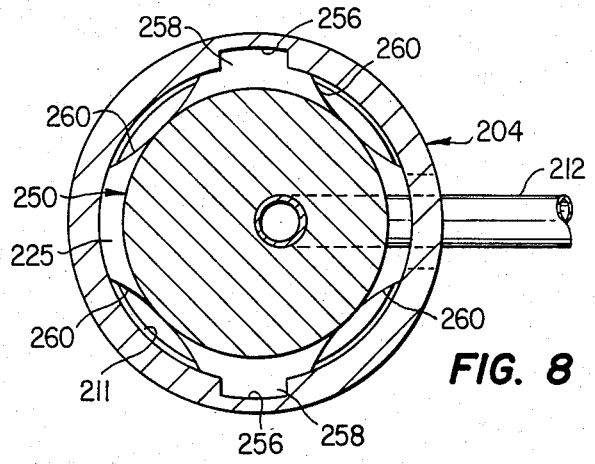
FIG. 8 is a section view taken along line 8—8 of FIG. 5.

As shown in FIG. 8, the casing section 204 is further provided with opposed recesses 256 for receipt of opposed radially extending projections 258 on the guide member 250 so that when the guide member is lowered into the interior of the casing section 204 it may be properly oriented rotationally to provide for registration of the passage 252 with the opening 254. The guide member 250 is engagable with the shoulder 211 to land the guide member in a predetermined axial position within the casing section 204, also. As shown also in FIG. 8, suitable recesses or grooves 260 are provided around the periphery of the guide member 250 to permit communication of the annular space 213 with the annular space 225 and to permit flow of drilling fluid from the borehole formed by the electrode tube 212 into the space 226 whereby circulation of drilling fluid during injection of the electrode tube 212 may be accomplished.

After locating the guide member 250 in the casing section 204, a second landing collar 238 is lowered into the wellbore on the drill pipe 222 and having the electrode tube 212 secured thereto. The landing collar 238 is engagable with latching dogs 236 formed on a boss portion 251 of the guide member 250 in a manner similar to the construction of the guide member 230. In this way, the landing collar 238 may be secured to the guide member 250 and rotation of the drill pipe 222 is permitted to decouple the drill pipe from the landing collar 238 connected to the electrode tube 212.

An alternative procedure for installing the guide members 230 and 250 and the respective electrode tubes 210 and 212 could be carried out by connecting the distal end of the electrode tube to the guide member by inserting the tube partially in the tube receiving passage and temporarily securing the tube to the guide member with shear screws or the like. The electrode tube and guide member would then be lowered in assembly until the guide member was seated in its intended position and the tube then forced on through the guide passage until the landing collar engages the boss on the guide member.

Those skilled in the art will recognize that additional guide members and landing collars similar in construction to the guide members 230, 250 and the landing collar 238 may be installed with associated electrode tubes to provide for a plurality of axially spaced apart and radially extending electrodes for the formation 12. Upon installation of a suitable number of electrode tubes, a connector member similar to the connector 102 for the embodiment of FIG. 1 would be installed as the last electrode tube guide member whereby, upon withdrawal of the drill pipe from the wellbore, a conductor tube such as the tube 116 having a connector member 118 secured thereto would be lowered into the wellbore and connected to the aforementioned guide member for completion of the electrical connection of the electrode tubes 210 and 212 with a source of electricity on the surface. The wellbore and the boreholes formed by the electrode tubes 210 and 212 may be flooded with an electrolyte by pumping said electrolyte into said wellbore by reverse circulation of fluid through spaces 226, 225 and 213.

One advantage of inserting or completing the well 200 using conventional drill pipe is that the relatively large diameter of the drill pipe 222 as compared with the electrode tubes 210 and 212 provides for more efficient hydraulic jetting action without suffering pressure and flow losses through the relatively small diameter tubing such as might be encountered in relatively deep wells using a system according to the embodiment of FIG. 1.

Although preferred electrode well completions and methods of installation have been described herein, those skilled in the art will recognize that various substitutions and modifications may be made to the inventive apparatus and methods without departing from the scope and spirit of the invention as defined in the appended claims.

What I claim is:

1. A method of providing an electrode well for electrical resistance heating of a subterranean formation comprising the steps of:

drilling a well into said formation to form a wellbore;

inserting at least one electrode member comprising a length of metal electrode tube into said formation by extending said electrode tube from means located at the surface of said formation through said well and diverting said electrode tube generally radially outwardly with respect to the central longitudinal axis of said well at a predetermined position in said formation by axially moving said electrode tube into said formation, the penetration of said electrode tube into said formation being enhanced by hydraulic jetting action, including the pumping of fluid through said electrode tube to the distal end thereof, during said insertion;

anchoring said electrode tube in a portion of said well adjacent said formation; and connecting said electrode tube to a source of electrical energy for resistance heating of said formation through electrically conductive contact of said electrode tube with said formation.

2. The method set forth in claim 1, including the step of:

inserting a selected plurality of said electrode tubes into said formation successively and connecting each of said electrode tubes to each other electrically and to said source of electrical energy.

3. The method set forth in claim 1, including the step of:

providing a guide member insertable into said wellbore including means for guiding said electrode tube to move from a generally axial direction in said wellbore radially outwardly into said formation and for electrically connecting one end of said electrode tube to conductor means in said wellbore.

4. The method set forth in claim 3, including the steps of:

providing successive ones of said guide members interconnected and arranged axially seriatim in said wellbore, each of said guide members being connected to and forming guide means for an electrode tube inserted into said formation; and inserting a conductor tube into said wellbore and connecting said conductor tube to a member in electrically conductive relationship with said guide members.

5. The method set forth in claim 1 including the step of:

providing a coiled tube injection unit and performing the step of inserting said electrode tube into said formation by forcibly injecting said electrode tube through said wellbore from the surface of said formation with said injection unit while pumping pressure fluid through said electrode tube.

6. The method set forth in claim 1 including the step of:

providing drilling apparatus including an elongated drill pipe and means connected to a distal end of said drill pipe for supporting said electrode tube;

lowering said electrode tube into said wellbore with said drill pipe and injecting said electrode tube into said formation while pumping pressure fluid through said drill pipe and said electrode tube to assist in forcing said electrode tube into said formation.

7. The method set forth in claim 6 including the step of:

providing a casing section in said wellbore;

providing first tube guide means insertable in said casing section in a predetermined position in said casing section;

inserting said first tube guide means into said casing section and locating said first tube guide means in said predetermined position;

extending said electrode tube through said first tube guide means and into said formation;

providing second tube guide means and inserting said second tube guide means into said casing section in a predetermined position relative to said first tube guide means;

extending another electrode tube through said second tube guide means and into said formation; and electrically interconnecting said electrode tubes with a source of electrical energy.

8. A method of providing an electrode well for electrical resistance heating of a subterranean formation comprising the steps of:

drilling a well into said formation to form a wellbore;

providing a casing section in said wellbore;

providing first tube guide means insertable in said casing section in a predetermined position in said casing section;

inserting said first tube guide means into said casing section and locating said first tube guide means in said predetermined position;

inserting at least one electrode member comprising a length of metal electrode tube into said formation by extending said electrode tube from means located at the surface of said formation through said well and said first tube guide means and diverting said electrode tube generally radially outwardly with respect to the central longitudinal axis of said well at a predetermined position in said formation by axially moving said electrode tube into said formation, the penetration of said electrode tube into said formation being enhanced by hydraulic jetting action, including the pumping of fluid through said electrode tube during said insertion;

anchoring said electrode tube in said casing section with said first tube guide means;

providing second tube guide means and inserting said second tube guide means into said casing section in a predetermined position relative to said first tube guide means;

extending another electrode tube through said second tube guide means and into said formation; and connecting said electrode tubes to a source of electrical energy for resistance heating of said formation through electrically conductive contact of said electrode tubes with said formation.

9. An electrode well for conducting electrical current into a subterranean formation to heat said formation for the production of hydrocarbon fluids, said well comprising:

means forming an elongated wellbore extending into said subterranean formation;

a plurality of elongated relatively thin-walled metal tubes extending radially outward from said wellbore into said formation, each of said tubes having been inserted into said formation by extension of a length of said tube from the earth's surface above said formation through said wellbore and radially outward from said wellbore into said formation, said insertion including hydraulically jetting a path for penetration of said tubes into said formation during the insertion thereof, respectively;

means for supporting said tubes in said wellbore; and connector means for connecting said tubes to a conductor extending to a source of electric energy.

10. The electrode well set forth in claim 9 wherein:

said means for supporting said tubes in said wellbore includes a casing section, and guide means insertable in said casing section and cooperable with said casing section to provide for guiding at least one of said tubes from a generally axial direction in said wellbore into a radial direction extending outwardly from said wellbore, said guide means including means for interconnecting successive ones of said guide means in axial stacked and electrically conductive relationship in said casing section.

11. The electrode well set forth in claim 9 wherein:

said guide means comprises a guide member having a passage formed therein comprising a first curved portion for guiding one of said tubes from a first direction to a second direction with respect to said wellbore, said passage including a second curved portion curving in a direction substantially opposite said first curved portion for straightening said tube as it exits said guide member.

12. The electrode well set forth in claim 9 wherein:

said means for supporting said tubes includes a collar member connected to one end of a tube and adapted to be connected to said guide means.

13. In an electrode well for conducting electrical current into a subterranean formation to heat said formation for the production of hydrocarbon fluids, said well comprising means forming an elongated wellbore extending into said subterranean formation, the improvement comprising:

a plurality of elongated electrode tubes adapted to be extended radially outward from said wellbore into said formation;

a plurality of axially stacked guide members insertable in said wellbore, each of said guide members being adapted to provide for guiding at least one of said tubes from a generally axial direction in said wellbore into a radial direction extending outwardly from said wellbore, selected ones of said guide members including means for interconnecting successive ones of said guide members in axial stacked and electrically conductive relationship in said wellbore for conducting electrical current through said electrode tubes into said formation; and connector means for electrically connecting said electrode tubes to a conductor extending to a source of electric energy.

14. The improvement set forth in claim 13 wherein:

said guide members each include a passage formed therein and having a first curved portion for guiding one of said tubes from a first direction to a second direction with respect to said wellbore.

15. The improvement set forth in claim 14 wherein:

said passage includes a second curved portion curving in a direction other than said first curved portion for straightening said tube as it exits said guide member.

16. The improvement set forth in claim 14 wherein:

said passage has an entrance portion which is coaxial with the axis of said wellbore when said guide member is disposed therein.

17. The improvement set forth in claim 13 wherein:

said guide members include cooperating portions which provide for interconnecting said guide members with each other in axially stacked relationship such that successive ones of said guide members provide for guiding said tubes in selected radial directions from said wellbore, respectively.

18. The improvement set forth in claim 13 including:

a generally cylindrical casing section in said wellbore and adapted to receive said guide members therein, means on said casing section cooperable with means on said guide members, respectively, for orienting said guide members to guide said electrode tubes in selected radial directions with respect to a central axis of said wellbore.

19. The improvement set forth in claim 13 including:

means associated with selected ones of said guide members for releasably securing said selected ones of said guide members to an elongated drill stem for installing said guide members in said wellbore.

20. The improvement set forth in claim 19 wherein:

said means for releasably securing said guide members to said drill stem includes a landing member connected to an electrode tube and to said drill stem, said landing member being adapted to be connected to said guide member upon insertion of said electrode tube into said formation through said guide member.

21. The improvement set forth in claim 13 wherein:

said electrode tubes each include a means forming a jet nozzle on their distal ends for jetting fluid into said formation during the insertion of said electrode tube into said formation, respectively.

* * * * *